United States Patent [19]

Santos

[11] 4,082,264

[45] Apr. 4, 1978

[54] STATIONARY EXERCISE BICYCLE

[76] Inventor: James P. Santos, 223 Rockingstone, Larchmont, N.Y. 10538

[21] Appl. No.: 748,198

[22] Filed: Dec. 7, 1976

[51] Int. Cl.[2] ..... A63B 69/16

[52] U.S. Cl. ..... 272/73; 272/130

[58] Field of Search ..... 272/73, 130, 72, 69, 272/116, 128, DIG. 1, DIG. 4, DIG. 5, DIG. 6, 99; 273/186 A, 191 R

[56] References Cited

U.S. PATENT DOCUMENTS

| | | | |
|---|---|---|---|
| 351,311 | 10/1886 | Conkling | 272/73 |
| 988,057 | 3/1911 | Zolper | 272/99 X |
| 1,313,081 | 8/1919 | Finney | 272/130 X |
| 3,081,634 | 3/1963 | Blaszkowski | 272/130 X |
| 3,373,992 | 3/1968 | Ludeman | 272/130 X |
| 3,494,616 | 2/1970 | Parsons | 272/73 |
| 3,670,723 | 6/1972 | Simjian | 272/73 X |
| 3,979,113 | 9/1976 | Uhl et al. | 272/73 |

FOREIGN PATENT DOCUMENTS

| | | | |
|---|---|---|---|
| 779,363 | 1/1935 | France | 272/73 |

*Primary Examiner*—Richard C. Pinkham
*Assistant Examiner*—Arnold W. Kramer
*Attorney, Agent, or Firm*—Hopgood, Calimafde, Kalil, Blaustein & Lieberman

[57] ABSTRACT

An exercise bicycle comprises a penumatic pump that includes a rotating member coupled to the pedals of the bicycle. The air pump absorbs the energy of the rotating pedals and thereby offers resistance to pedal rotation. The inlet of the pump is in communication with the atmosphere and the air outlet of the pump includes a valve restricting the flow of air prior to exhaust. The valve may be adjustable so as to selectively vary the resistance to pedal movement.

2 Claims, 5 Drawing Figures

STATIONARY EXERCISE BICYCLE

The present invention relates generally to exercise equipment, and, more particularly, to an exercise bicycle utilizing a pneumatic device to produce resistance to body movement.

The use of exercise equipment has been increasingly popular both in homes and in establishments such as gymnasiums and clubs. Riding a bicycle has long been recognized as an excellent activity to exercise the legs and to provide overall body conditioning. As a result, numerous designs of exercise equipment, commonly called an exercise bicycle, have been made which permit an individual to obtain exercise of the type derived from riding a bicycle without having to leave his home.

The conventional exercise bicycle, which has an appearance similar to a conventional bicycle, includes pedals connected to a common shaft on which is secured a link chain sprocket. The sprocket is engaged to a link chain which runs to a second sprocket attached to a front wheel. The wheel is typically rubber faced and elevated off the floor and functions as part of the friction or resistance mechanism, which consists of a small rubber-faced wheel attached to a lever whose fulcrum is approximately in the center and whose other end houses a manually operated screw whose end presses against a plane. As the screw is rotated, it elevates that end of the lever thereby lowering and pressing the small rubber wheel on the opposite end against the rubber face of the front wheel. This action creates a variable resistance resulting in greater or lesser pedal pressure to overcome the resistance generated.

Although this resistance to pedaling simulates the experience of riding a bicycle, the conventional exercise bicycle presents several problems and hazards to the user. The chain and sprocket require a guard to minimize the possibility of clothing getting caught in the mechanism. Since the bicycle is stationary, children may be injured when the chains and sprockets are turning at high rates of speed. In addition, the front wheel and spokes pose an additional danger for children, particularly with the substantial flywheel effect of the rotating wheel. There is also a high noise level generated by the many moving parts of the chain and sprockets. In addition, adjustment for consistent tensioning is difficult because mechanical devices can change or lose adjustment by loosening or wear as well as temperature changes affecting the large rubber frictional surfaces.

Attempts at designing an exercise bicycle in which the front wheel and associated chain and sprocket are eliminated, such as that disclosed in U.S. Pat. No. 3,494,616, make use of a closed-system fluid pump to create the resistance to pedaling. In this mechanism the viscosity of the fluid circulated through the pump is altered by heating during operation and thus changes the resistance of the pedals. Moreover, should a leak develop in the pump system, the fluid will drain onto the floor causing a messy condition. Defects are also found in those exercise bicycles that use brake blocks, such as those produced by the expansion of the friction blocks and the objectionable particles emitted during block wear.

It is a principal object of the invention to provide a new and improved exercise bicycle eliminating the shortcomings and hazards of the devices currently in use while retaining the benefits with substantially simpler construction.

It is a further object of the invention to provide an exercise bicycle of the type described which has a minimum number of moving parts, and which is safe and clean in operation.

The exercise bicycle of the invention comprises an open-system pneumatic rotary or centrifugal type pump whose shaft is connected to conventional bicycle pedals and arms. The pump is actuated by the movement of the pedals and generates pneumatic pressure or vacuum and flow. The inlet of the pump is in communication with the ambient atmosphere and the outlet is connected to a valve restricting the flow of air prior to exhausting. In the case of a vacuum pump, the restricting valve may be positioned on the inlet side.

To the accomplishment of the above and to other advantages as may hereinafter appear, the present invention relates to an exercise bicycle, substantially as defined in the appended claims and as described in the following specification as considered with the accompanying drawings, in which:

Figure 1:
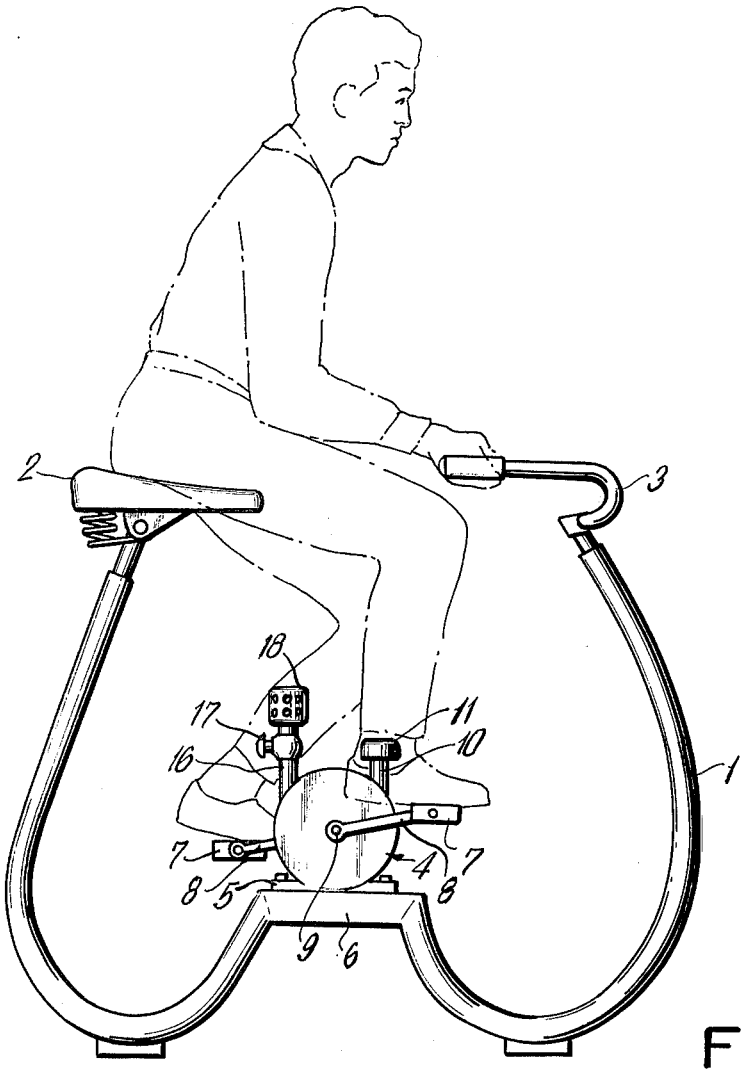
FIG. 1 is a side view of an exercise bicycle embodying the present invention.
Figure 2:
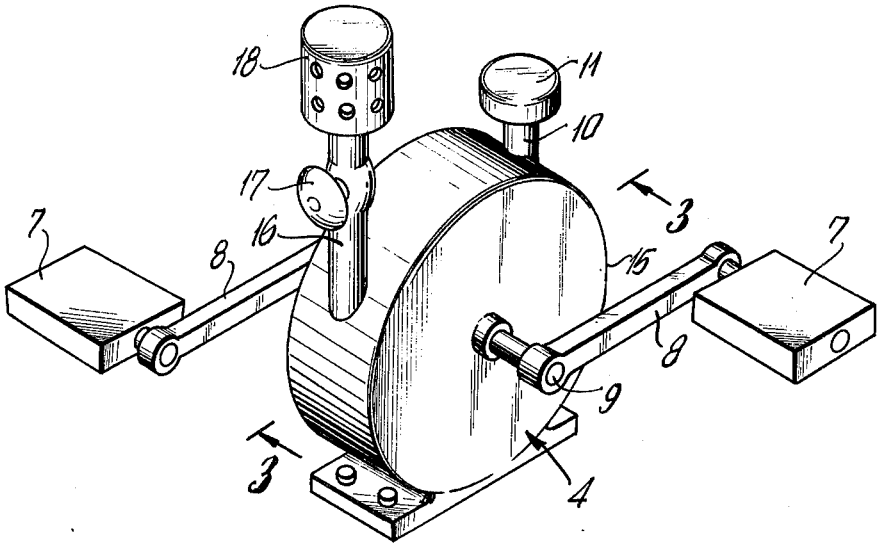
FIG. 2 is a perspective view of the pneumatic pump as employed in the exercise bicycle of FIG. 1.

The exercise bicycle of the invention, as illustrated in the embodiment of FIG. 1, comprises a frame 1 adapted to rest on the floor, a seat 2, and handlebars 3, which may be adjustable in height and rotation. A pneumatic pump 4, which may be a turbine, centrifugal sliding vane or other type of pneumatic pump, is attached by its base 5 to a bed plate 6, which is formed in frame 1. Pump 4, as shown best in FIG. 2, contains bicycle pedals 7 attached to pedal arms 8 that are, in turn, attached to end rotate about a shaft 9 that constitutes the shaft of the pneumatic pump. An intake pipe 10 carries outside air from an intake filter or screen 11 to pump 4.

Figure 3:
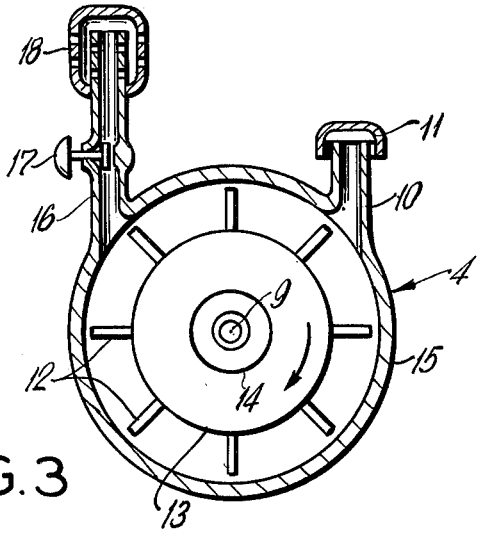
FIG. 3 is a cross-sectional view of the mechanism taken across lines 3—3 of FIG. 2.
Figure 4:
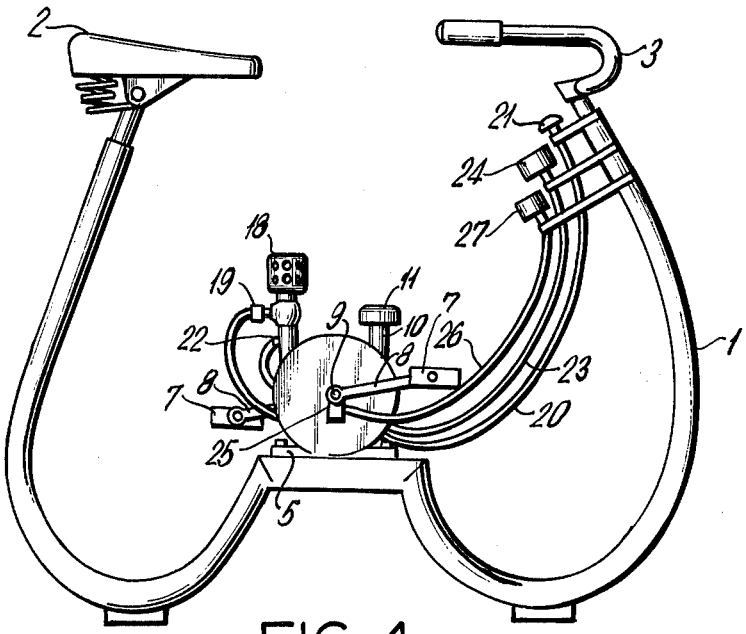
FIG. 4 is a side view of the exercise bicycle showing some attachments that may be added.

The air travels through the pump 4 propelled by radial vanes 12 which are attached to an armature 13 that is integral with a hub 14 keyed to shaft 9. As the assembly rotates in a clockwise direction, as viewed in FIGS. 2, 3, and 5, the air within the pump builds up pressure as vanes 12 rotate relative to the pump housing 15. Prior to exhausting at an outlet pipe 16, the air in the pump reaches a maximum pressure determined by the adjustable setting of an outlet valve 17 that determines the degree of restriction and therefore the pressure that can be developed by the pump. Valve 17 (as viewed in FIGS. 2 and 5) acts as a pneumatic flow-restricting device. The air passes through valve 17 to a muffler 18 that suppresses noise and reduces the velocity of the exhausted air. As shown in FIG. 4, valve operation can be remotely controlled such as by an attachment 19, connected through a flexible shaft 20 to a valve 21 mounted on the front of frame 1. More precise settings and resistance monitoring may be obtained by the attachment of a pressure or vacuum gauge from a fitting 22 through a flexible hose 23 and to a gauge 24. Another attachment can be an odometer drive 25 operating off the pedal shaft attached to a flexible shaft 26 and to the odometer 27.

Figure 5:
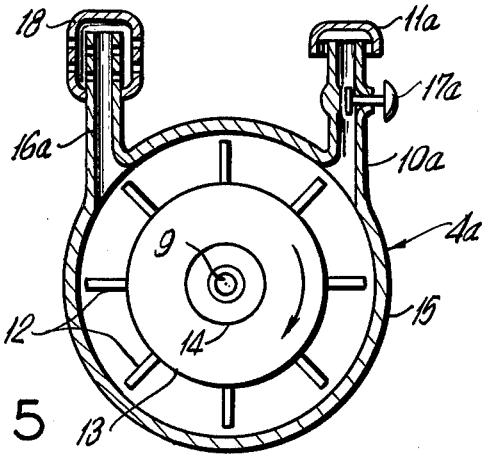
FIG. 5 is a cross-sectional view of an alternative resistance mechanism for use in the exercise bicycle of the invention.

An alternative embodiment of the pump that may be employed in the exercise bicycle of the invention is illustrated in FIG. 5, in which the pump is in the form of a vacuum pump 4*a*. The inlet air passes through a filter or screen and then through an adjustable restricting valve 17*a* to an inlet pipe 10*a* and into the pump where a vacuum is produced as vanes 12 rotate relative to pump housing 15 and passes to the exhaust outlet pipe 16*a* prior to passing through muffler 18 into the atmosphere.

The pump may also have a silencer and/or screen for either the inlet or exhaust side to prevent any sound or higher velocity air flow. The open system allows air to pass through thereby furnishing adequate cooling, stable temperatures and, therefore, uniform resistance.

It will be appreciated that the use of an open-system pneumatic pump as the means of absorbing energy in an exercise bicycle eliminates the potentially hazardous chain and sprocket and front wheel of conventional exercise bicycles and also reduces the complexity and number of moving parts as compared to the conventional exercise bicycle.

In addition, the use of air as the resisting medium will cause no harm or damage to floors or rugs on which the bicycle is placed, should there be a seal leak, in contrast to leaking hydraulic fluids in some of the proposed designs. Noise and wear will be virtually eliminated by the bicycle of the invention, which, in addition, is lighter in weight and smaller than conventional machines, making it easier to ship, transport and store. Furthermore, more precise adjustments can be maintained to the resistance to pedal movement due to the nature of flow restriction employed as compared to the friction-inducing mechanical parts used in conventional exercise bicycles.

It will also be understood that modifications may be made to the embodiments of the invention herein specifically described by those skilled in the art without necessarily departing from the spirit and scope of the invention.

What is claimed is:

1. An exercise bicycle comprising a stationary frame, pneumatic pump means attached to said frame and including a rotatable shaft, pedals secured to said shaft for producing rotation thereof, said pneumatic pump means further including a chamber, a plurality of radial vanes secured to said shaft in said chamber, an inlet in communication with the ambient atmosphere and with said chamber, and an outlet air-restricting valve in communication with said chamber and allowing air, acted upon by said vanes in said chamber, to flow therethrough and thence to an outlet to the ambient atmosphere.

2. The exercise bicycle of claim 1, further including means for modifying the restriction to outlet air provided by said valve.

* * * * *